United States Patent [19]

Curren et al.

[11] Patent Number: 4,607,193

[45] Date of Patent: Aug. 19, 1986

[54] TEXTURED CARBON SURFACES ON COPPER BY SPUTTERING

[75] Inventors: Arthur N. Curren, North Ridgeville; Kenneth A. Jensen, Bay Village; Robert F. Roman, Brookpark, all of Ohio

[73] Assignee: The United States of America as represented by the Administrator of the National Aeronautics and Space Administration, Washington, D.C.

[21] Appl. No.: 659,475

[22] Filed: Oct. 10, 1984

[51] Int. Cl.[4] ..... H01J 23/02; C23C 15/00

[52] U.S. Cl. ..... 315/5.38; 204/192 C; 204/192 D; 204/298; 313/106; 313/107; 427/39; 427/41

[58] Field of Search ..... 204/192 R, 192 C, 192 D, 204/192 N, 192 E, 298; 313/106, 107; 315/5.38; 427/38, 39, 41

[56] References Cited

U.S. PATENT DOCUMENTS

| | | | |
|---|---|---|---|
| 3,540,989 | 11/1970 | Webb | 204/168 |
| 3,549,930 | 12/1970 | Katz | 313/44 |
| 3,702,951 | 11/1972 | Kosmahl | 315/5.38 |
| 4,173,522 | 11/1979 | Pulker et al. | 204/192 C |
| 4,349,424 | 9/1982 | Sovey et al. | 204/192 E |
| 4,414,085 | 11/1983 | Wickersham et al. | 204/192 |
| 4,417,175 | 11/1983 | Curren et al. | 315/538 |
| 4,437,962 | 3/1984 | Banks | 204/192 R |
| 4,486,286 | 12/1984 | Lewin et al. | 204/192 R |
| 4,490,229 | 12/1984 | Mirtich et al. | 204/192 R |
| 4,495,044 | 1/1985 | Banks | 204/192 R |
| 4,524,106 | 6/1985 | Flasck | 204/192 C |

FOREIGN PATENT DOCUMENTS

| | | | |
|---|---|---|---|
| 49-34596 | 9/1974 | Japan | 204/192 C |
| 0010394 | 1/1978 | Japan | 204/192 C |
| 0021902 | 2/1978 | Japan | 204/192 C |
| 2069008 | 8/1981 | United Kingdom | 204/192 C |

OTHER PUBLICATIONS

Marinkovic et al., "Preparation and Properties of Sputtered 'Glassy' Carbon Films," Carbon, 1976, vol. 14, No. 6, pp. 329–331.

NASA Technical Paper 1097 "Secondary-Electron-Emission Properties of Conducting Surface with Application of Multistage Depressed Collectors for Microwave Amplifiers" Forman-Nov. 1977.

NASA Technical Paper 2285 "Beam Impingement Angle Effects on Secondary Electron Emission Characteristics of Textured Pyrolytic Graphite" Curren et al-Feb. 1984.

*Primary Examiner*—John F. Niebling
*Assistant Examiner*—Terryence Chapman
*Attorney, Agent, or Firm*—Gene E. Shook; John R. Manning

[57] ABSTRACT

A very thin layer of highly textured carbon is applied to a copper surface by a triode sputtering process. A carbon target 10 and a copper substrate 12 are simultaneously exposed to an argon plasma 14 in a vacuum chamber.

The resulting carbon surface is characterized by a dense, random array of needle-like spires or peaks which extend perpendicularly from the copper surface. The coated copper is especially useful for electrode plates in multistage depressed collectors.

16 Claims, 6 Drawing Figures

TEXTURED CARBON SURFACES ON COPPER BY SPUTTERING

ORIGIN OF THE INVENTION

Invention described herein was made by employees of the U.S. Government and may be manufactured and used by or for the Government for governmental purposes without the payment of any royalties thereon or therefor.

TECHNICAL FIELD

This invention is directed to providing surfaces having extremely low secondary electron emissions. The invention is particularly concerned with forming a textured carbon surface on a copper substrate.

Surfaces exhibiting low secondary electron emission are required for high efficiency electrodes that are used in multistage depressed collectors for microwave amplifier traveling-wave tubes. These devices, which are widely used in space communications, aircraft, and terrestrial applications, are described in U.S. Pat. No. 3,702,951 to H. Kosmahl.

Among the significant factors in maximizing multistage depressed collector efficiency is the use of electrode materials having low secondary electron emission characteristics. This is discussed in U.S. Pat. No. 4,349,424 to Sovey et al.

The electrodes must have low secondary electron emission characteristics so that the impinging electrons are not excessively reflected or re-emitted from the surfaces. This insures that maximum kinetic energy is recovered from the spent electron beam after it has passed through the interaction section of the traveling-wave tube and entered the multistage depressed collector.

It has been proposed to use copper plates in the multistage depressed collectors. However, in an untreated condition copper surfaces have relatively high secondary electron emission levels.

It is, therefore, an object of the present invention to apply a very thin layer of highly textured carbon to a copper surface by triode sputtering.

BACKGROUND ART

Prior art treatments to reduce secondary electron emission from copper surfaces included the topical application of materials having lower emission levels than untreated copper. Examples of such prior art treatments include the application of a thin titanium carbide film to a copper substrate as disclosed in a 1977 NASA Technical Paper 1097. This publication discloses another approach to the treatment of copper in which a textured surface is created by a simultaneous sputter-application of a low sputter-yield material, such as tantalum or stainless steel, to the copper which is then exposed to ion bombardment.

The formation of a hard, nonporous polycrystalline carbon film on an ion-cleaned copper substrate by ion bombardment from an ionized carbon source gas is described in U.S. Pat. No. 3,540,989 to Webb. Another attempt to improve a multistage depressed collector electrode comprises the substitution of smooth or moderately roughened graphite for the copper electrodes as described in U.S. Pat. No. 3,549,930 to Katz. Another technique utilizes ion-textured pyrolytic graphite for copper as electrode material as set forth in U.S. Pat. No. 4,417,175 to Curren et al.

One of the major disadvantages of coating copper surfaces with materials having relatively lower secondary electron emission characteristics than copper itself, such as titanium carbide or hard, nonporous polycrystalline carbon films by these prior art methods is that the resulting emission characteristics, while lower than for untreated copper, are not reduced to their lowest attainable levels. Similarly, the seeded and ion-bombarded textured copper surfaces, while yielding secondary electron emission levels significantly lower than for untreated copper, nevertheless do not produce the lowest attainable emission level.

While the ion-textured pyrolytic graphite exhibits secondary electron emission characteristics sharply lower than those of untreated copper and the other surfaces described in the prior art, the use of this textured pyrolytic graphite also has disadvantages. More particularly, this material is porous and special, time-consuming, and expensive procedures are required to remove entrapped and surface gases before the graphite can be used in a high-vacuum, high-voltage environment such as multistage depressed collector electrodes experience. Further in order to use graphite components in complex assemblies such as multistage depressed collectors, these components must be suitably attached to support structures, preferably by brazing. Such procedures require special development for reliable graphite-to-ceramic or metal interfaces, particularly for highly anisotropic pyrolytic graphite. Because of these costly complications, manufacturers of traveling-wave tubes using multistage depressed collectors are reluctant or unwilling to adopt the use of graphite electrodes.

DISCLOSURE OF THE INVENTION

According to the present invention a very thin layer of highly textured carbon is applied to a copper surface by a sputtering process. The carbon surface is characterized by a dense, random array of needle-like spires or peaks which extend perpendicularly from the local copper surface.

These spires are approximately seven micrometers in height and are spaced approximately three micrometers apart, on the average. The copper substrate is essentially completely covered by the carbon layer, which is tenacious and is not damaged by vibration loadings representative of usual and anticipated multistage depressed collector applications.

BRIEF DESCRIPTION OF THE DRAWING

The details of the invention will be more fully described when taken with the accompanying drawings wherein.

BEST MODE FOR CARRYING OUT THE INVENTION

Figure 1:
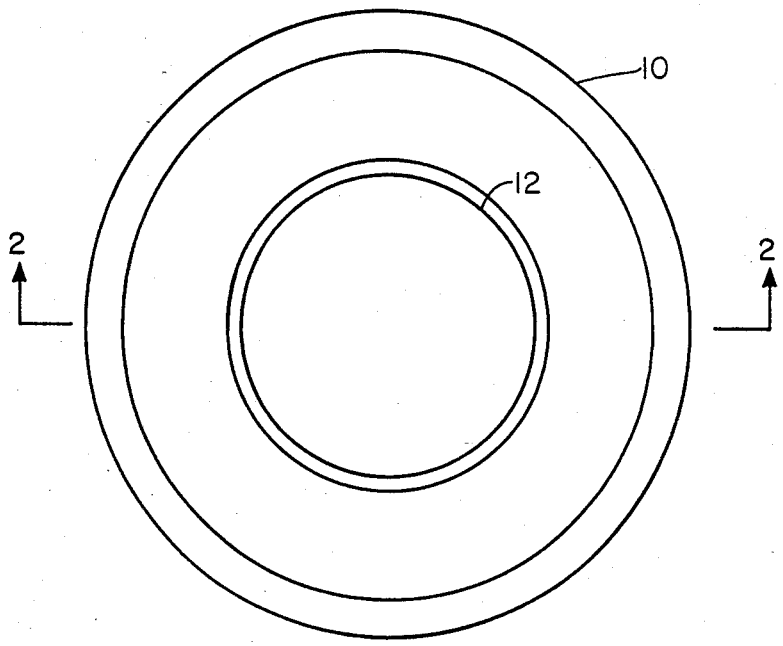
FIG. 1 is a plan view of a portion of the apparatus used in the sputter application of textured carbon surfaces on copper substrates.
Figure 2:
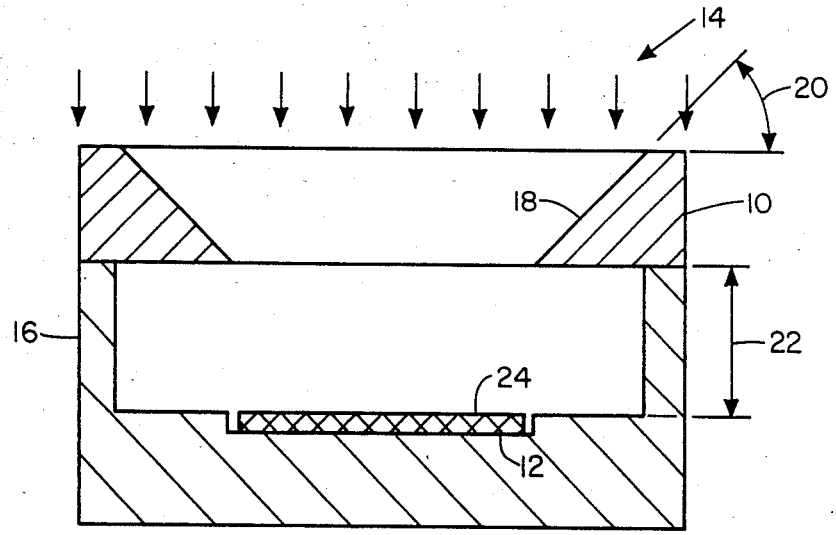
FIG. 2 is a vertical half-section view taken along the line 2—2 in FIG. 1.

The carbon surface of the present invention is applied to a copper substrate by a triode sputtering process in which an annular carbon target 10 and a copper substrate 12 are simultaneously exposed to an argon plasma 14 in a low pressure enviroment as shown in FIGS. 1 and 2. Other than the removal of oxide and/or oil or dirt from the copper by simple abrasion of the surface, no special pre-texturing treatment of the copper is required.

The carbon target 10 and the copper substrate 12 are maintained at the same electrical potential relative to the plasma 14 during the texturing process by an electrically conductive fixture 16. In a typical example where the substrate 12 is circular in shape as shown in FIG. 1, the carbon target 10 closely surrounds the substrate and is contoured so that its surface 18 which faces the plasma 14 slopes radially upward and outward at an angle 20 which is approximately 45°.

The target 10 is mounted adjacent to the substrate 12 a distance 22 that is approximately one-half the diameter of the substrate. This positioning ensures a uniform application of a textured carbon layer 24 on the substrate 12.

Referring now to FIG. 2 the copper substrate 12 having a surface that is to be covered with the textured carbon layer is mounted in the fixture 16. The surface of the substrate 12 is exposed to a beam 14 of 1000 eV to 1500 eV argon ions at current densities of 4.0 mA/cm$^2$ to 10 mA/cm$^2$.

The argon ion beam 14 is furnished by an electron bombardment ion source modified from the type developed for electric propulsion technology. Argon gas from a suitable source is fed through a line to a cathode in a chamber within the source where the gas is ionized. The argon ions are retained within this chamber which also contains an anode about its outer periphery. Such an ion source is described in a 1984 NASA Technical Paper 2285. It will be appreciated that other gases, in addition to argon can be used to form the bombarding ions in the beam 14. For example, xenon may also be used.

Figure 3:
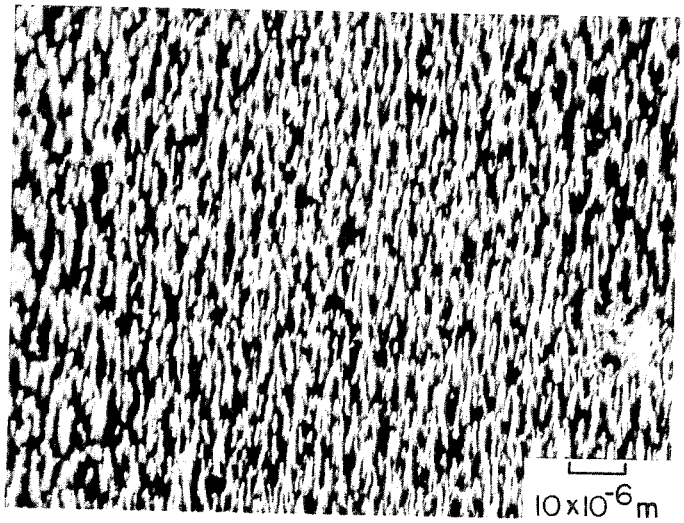
FIG. 3 is a photomicrograph at an angle of 30° to the surface of a textured surface formed on a copper substrate in accordance with the present invention.

The electron bombardment ion source and the fixture 16 are located in a vacuum facility which is sufficiently large to prevent back sputtered facility materials from contaminating the process. The operating conditions which were used to produce the specific surface shown in FIG. 3 are as follows:

Pressure: $2.66\times10^{-3}$ Pa ($2\times10^{-5}$ torr)
Accelerating potential: 1500 Vdc
Surface current density: 5 mA/cm$^2$
Texturing period: 3 hours The resulting highly textured carbon surface is characterized by a dense, random array of needle-like spires or peaks extending perpendicular to the substrate 12. The spires are approximately seven micrometers in height and are spaced about three micrometers apart. The carbon surface texture characteristics and consequently the secondary electron emission characteristics may be altered from those of the surface described by varying these operating conditions within reasonable limits.

Most of the electrons in a primary electron beam which impinges the textured carbon layer strike the conical sloping walls of the spires or at the base of the spires. Secondary electrons which are then emitted from these regions are repeatedly intercepted with the consequently repeated partial retention by nearby adjacent spire walls. This greatly reduces net emission from the normal projected surface area. The highly textured surface therefore is the principal factor in producing extremely low secondary electron emission characteristics exhibited by this material.

A beneficial technical effect of this invention over the prior art is the formation of the highly-textured carbon layer on the copper substrate. This results in extremely low secondary electron emission levels for the copper for which fabrication and brazing technology are well-developed and reliable. The developed emission characteristics compare very closely to those of ion-textured pyrolytic graphite. Moreover, because the textured carbon layer is extremely thin, outgassing procedures for high-vacuum, high-voltage application are simple and require only brief processing periods as opposed to the use of graphite or carbon substrates which are necessarily thicker because of structural requirements. Another advantage of this invention is the use of solid carbon sputtering target components in a simple system which requires only relatively low plasma-to-target and substrate voltage differences as opposed to the use of dual ionizing gases including a potentially hazardous hydrocarbon gas, much higher voltage requirements, and a special substrate ion-cleaning procedure.

Figure 4:
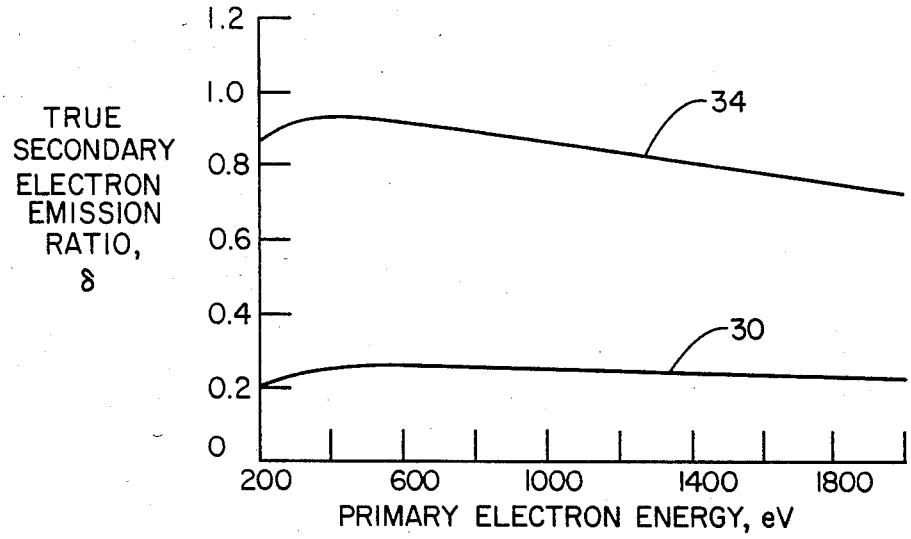
FIG. 4 is a graph showing true secondary electron emission ratios plotted as a function of primary electron energy for two materials.
Figure 5:
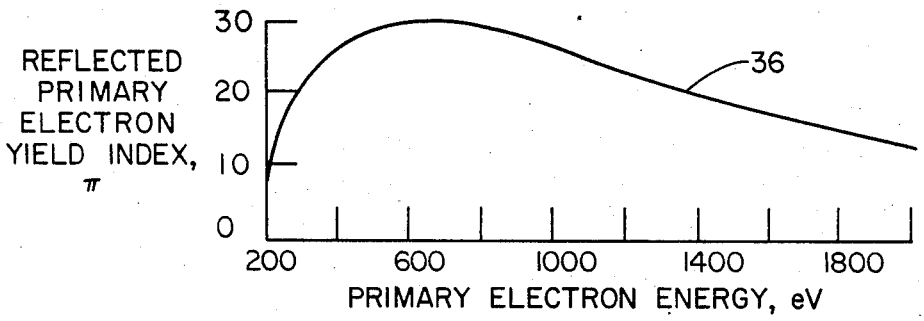
FIG. 5 is a graph of the reflected primary electron yield index plotted as a function of primary electron energy for an untreated copper surface.
Figure 6:
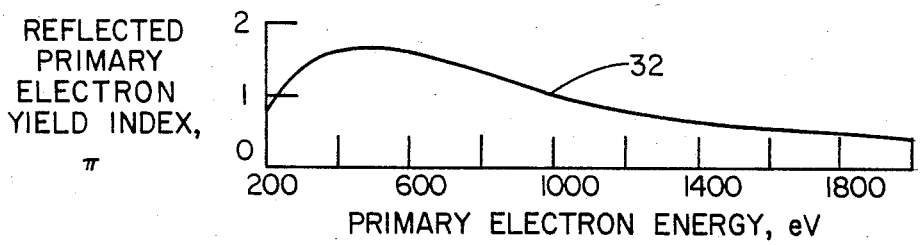
FIG. 6 is a graph of the reflected primary electron yield index plotted as a function of primary electron energy for a textured carbon surface on a copper substrate.

The secondary electron emission characteristics for direct electron beam impingement and for a representative primary electron beam energy range for the surface produced in accordance with the present invention are shown in FIGS. 4, 5 and 6. The true secondary electron emission ratio, which is the ratio of low energy emitted electrons to impinging electrons, is shown by the curve 30 in FIG. 4. The reflected primary electron yield indexed to that of a sooted control surface at 1000 eV primary beam energy, is shown by the curve 32 in FIG. 6. For comparison, characteristics curves 34 and 36 for untreated copper are also shown in both FIGS. 4 and 5, respectively. The sharply lower emission levels for the surface of the present invention relative to those of the untreated copper are clearly evident.

While methods of producing the described textured carbon surface on a copper substrate by means other than that described above may be utilized, it is appreciated that those familiar with the art may make modifications and/or substitute equivalents in the procedures as described without departing from the spirit of the invention or the scope of the subjoined claims.

We claim:

1. A method of producing a textured carbon surface on a copper substrate comprising the steps of mounting said substrate and a carbon target in a vacuum environment of about $2\times10^{-5}$ torr, simultaneously bombarding both said substrate and said target with a beam of ions having energies between about 1000 eV and about 1500 eV and an ion beam current density between about 4.0 mA/cm$^2$ and about 10 mA/cm$^2$, and maintaining said substrate and said carbon target at the same electrical potential relative to said ion beam during said bombardment.

2. A method of producing a textured carbon surface as claimed in claim 1 wherein said substrate and said target are simultaneously exposed to a xenon ion beam.

3. A method of producing a textured carbon surface as claimed in claim 1 wherein said substrate and said target are simultaneously exposed to an argon ion beam.

4. Method of producing a textured carbon surface as claimed in claim 3 wherein the argon ion beam has a current density of about 5.0 $mA/cm^2$ at an accelerating potential of about 1500 V dc.

5. A method of producing a textured carbon surface as claimed in claim 4 wherein said substrate and said target are simultaneously sputtered for about three hours.

6. Apparatus for producing a textured carbon surface on a copper substrate comprising means for providing a low pressure environment about said substrate, means for furnishing a beam of ions having energies between about 1000 eV and about 1500 eV in said low pressure environment, means for mounting said substrate in said ion beam, a carbon target mounted in said ion beam adjacent to a surface of said substrate, and means for maintaining said substrate and said target at the same electrical potential relative to said ion beam.

7. Apparatus as claimed in claim 6 including an electron bombardment ion source for furnishing a beam of xenon ions.

8. Apparatus as claimed in claim 6 including an electron bombardment ion source for furnishing a beam of argon ions.

9. Apparatus as claimed in claim 8 wherein said argon ion beam has a current density between about 4.0 $mA/cm^2$ to about 10 $mA/cm^2$.

10. Apparatus as claimed in claim 9 including a chamber having a pressure of about $2\times10^{-5}$ torr.

11. Apparatus as claimed in claim 6 including an electrically conductive fixture for mounting said substrate and said target in said ion beam.

12. Apparatus as claimed in claim 6 including an annular carbon target spaced from said substrate toward said ion source in said argon ion beam, said target having a surface facing toward said ion beam, said surface sloping radially outward at an angle of about 45°.

13. Apparatus as claimed in claim 12 wherein the substrate has a circular configuration and the carbon target is spaced therefrom a distance approximately one-half the diameter of said substrate.

14. In a multistage depressed collector having a retarding electric field for slowing charged particles in a beam prior to being collected, the improvement comprising a plurality of copper electrode plates adjacent to said beam for intercepting said slowed charged particles, each of said copper plates having a textured carbon surface comprising a dense array of spires which extend perpendicularly from said copper plate.

15. A multistage depressed collector as claimed in claim 14 wherein each of said carbon spires has a height of about seven micrometers.

16. A multistage depressed collector as claimed in claim 15 wherein said carbon spires are spaced approximately three micrometers apart.

* * * * *